US010292474B2

(12) United States Patent
Delabastide

(10) Patent No.: US 10,292,474 B2
(45) Date of Patent: May 21, 2019

(54) LIQUID DISPENSING COMB

(71) Applicant: Monica Delabastide, Brooklyn, NY (US)

(72) Inventor: Monica Delabastide, Brooklyn, NY (US)

( * ) Notice: Subject to any disclaimer, the term of this patent is extended or adjusted under 35 U.S.C. 154(b) by 243 days.

(21) Appl. No.: 15/050,605

(22) Filed: Feb. 23, 2016

(65) Prior Publication Data

US 2016/0286929 A1 Oct. 6, 2016

Related U.S. Application Data

(60) Provisional application No. 62/140,782, filed on Mar. 31, 2015.

(51) Int. Cl.

| | |
|---|---|
| ***A45D 24/22*** | (2006.01) |
| ***A45D 24/26*** | (2006.01) |
| ***A45D 19/02*** | (2006.01) |
| *A45D 24/00* | (2006.01) |

(52) U.S. Cl.

CPC ..... *A45D 24/26* (2013.01); *A45D 19/02* (2013.01); *A45D 2024/005* (2013.01)

(58) Field of Classification Search

CPC ..... A45D 24/26; A45D 24/22; A46B 11/002; A46B 11/0041

USPC ..... 132/112–114

See application file for complete search history.

(56) References Cited

U.S. PATENT DOCUMENTS

| | | | | |
|---|---|---|---|---|
| 2,122,715 | A * | 7/1938 | Forte | A45D 24/26 132/116 |
| 2,278,811 | A * | 4/1942 | Wallenius | A45D 24/26 119/603 |
| 2,594,721 | A * | 4/1952 | Beebe | A45D 24/26 132/111 |
| 3,147,757 | A * | 9/1964 | Hofmann | A45D 24/26 132/114 |
| 5,975,089 | A * | 11/1999 | Simon | A45D 24/26 132/112 |
| 6,035,806 | A | 3/2000 | Lorenzo | |
| 6,047,704 | A * | 4/2000 | Giordano | A45D 2/122 132/122 |
| 6,332,726 | B2 * | 12/2001 | Yamamoto | A45D 19/02 401/183 |
| 6,962,158 | B1 * | 11/2005 | Anguelo | A45D 24/22 132/113 |

(Continued)

*Primary Examiner* — Tatiana L Nobrega

(74) *Attorney, Agent, or Firm* — Global Intellectual Property Agency, LLC; Daniel Boudwin

(57) ABSTRACT

A liquid dispensing comb for untangling hair. The liquid dispensing comb includes a handle attached to a head, wherein the head is hollow and includes a shaft extending from the handle and a plurality of tines extending perpendicularly from the shaft. A plurality of apertures are included along the length of each tine so to allow liquid to pass therethrough. Further, each tine alternates in length so as to allow the comb to access varying depths of a portion of tangled hair. A bladder is disposed within the interior of the handle, wherein the bladder can store and selectively release liquid into the head of the comb. In use, the bladder is actuated or pressed, wherein liquid is forced outward therefrom, into the tines, and out through the apertures, such that the hair is wetted with water or untangling liquid as the user combs through tangled hair.

6 Claims, 2 Drawing Sheets

(56) References Cited

U.S. PATENT DOCUMENTS

| | | | | |
|---|---|---|---|---|
| 7,322,363 | B1 * | 1/2008 | Dillard | A45D 24/26 132/112 |
| 7,334,583 | B2 * | 2/2008 | Niv | A45D 19/0008 132/112 |
| 8,347,894 | B1 | 1/2013 | Stewart et al. | |
| 2008/0210251 | A1 | 9/2008 | Dallianis et al. | |
| 2009/0126752 | A1 * | 5/2009 | Emerson | A45D 24/22 132/200 |
| 2012/0279513 | A1 | 11/2012 | Blauser et al. | |
| 2015/0265025 | A1 * | 9/2015 | Alsalameh | A45D 24/22 132/113 |
| 2016/0166032 | A1 * | 6/2016 | Grez | A45D 24/22 132/221 |

* cited by examiner

LIQUID DISPENSING COMB

CROSS REFERENCE TO RELATED APPLICATION

This application claims the benefit of U.S. Provisional Application No. 62/140,782 filed on Mar. 31, 2015. The above identified patent application is herein incorporated by reference in its entirety to provide continuity of disclosure.

BACKGROUND OF THE INVENTION

The present invention relates to comb devices. More specifically, the present invention provides a comb configured to dispense liquid therefrom.

Many hairdressers and hair stylists spend a significant amount of time untangling a client's hair due to knots formed. In addition to being time consuming, untangling hair is extremely painful due to the tugging and pulling a comb through the hair. Unnecessary hair loss can occur if an individual pulls too hard with a comb, resulting in the tangled hair becoming caught on the comb and pulled out from his or her scalp. Furthermore, individuals with a sensitive scalp can experience intense pain, irritation, and excessive hair loss when trying to comb out tangles and knots.

Conventional combs include tines extending at a uniform length therefrom. The uniform length of the tines prevents the comb from untangling hair at various depths of the knot, resulting in excessive combing. Further, many people will wet or wash their hair before using a comb to untangle and remove knots therefrom. However, this is also time consuming and requires additional grooming supplies in order to continuously spray or wet hair. Therefore, there exists a need for a comb configured to untangle knots and allow a user to selectively dispense liquid onto hair.

Devices have been disclosed in the prior art that relate to comb devices. These include devices that have been patented and published in patent application publications. These devices generally relate to combs and brushes that dispense liquid, such as U.S. Patent Application Publication No. 2012/0279513, U.S. Patent Application Publication Number 2008/0210251, U.S. Pat. Nos. 8,347,894, 6,035,806, and U.S. Patent Application Publication No. 2009/0126752.

These prior art devices have several known drawbacks. These devices comprise a comb with a reservoir therein which expels liquid from between the tines of a comb during compression of the reservoir. However, these devices fail to provide a plurality of tines alternating in length and each comprising a plurality of liquid dispensing apertures along the length thereof in order to provide a means for untangling hair at various depths on a user's head.

In light of the devices disclosed in the prior art, it is submitted that the present invention substantially diverges in design elements from the prior art and consequently it is clear that there is a need in the art for an improvement to existing comb devices. In this regard the instant invention substantially fulfills these needs.

SUMMARY OF THE INVENTION

In view of the foregoing disadvantages inherent in the known types of liquid dispensing combs now present in the prior art, the present invention provides a new liquid dispensing comb wherein the same can be utilized for providing convenience for the user when combing hair in order to remove tangles or knots therefrom.

It is therefore an object of the present invention to provide a new and improved comb device that has all of the advantages of the prior art and none of the disadvantages. The liquid dispensing comb comprises a handle attached to a head, wherein the head is hollow and includes a shaft extending from the handle and a plurality of tines extending perpendicularly from the shaft. A plurality of apertures are included along the length of each tine so to allow liquid to pass therethrough. Further, each tine alternates in length so as to allow the comb to access varying depths of a portion of tangled hair. A bladder is disposed within the interior of the handle, wherein the bladder is configured to store and selectively release liquid into the head of the comb.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
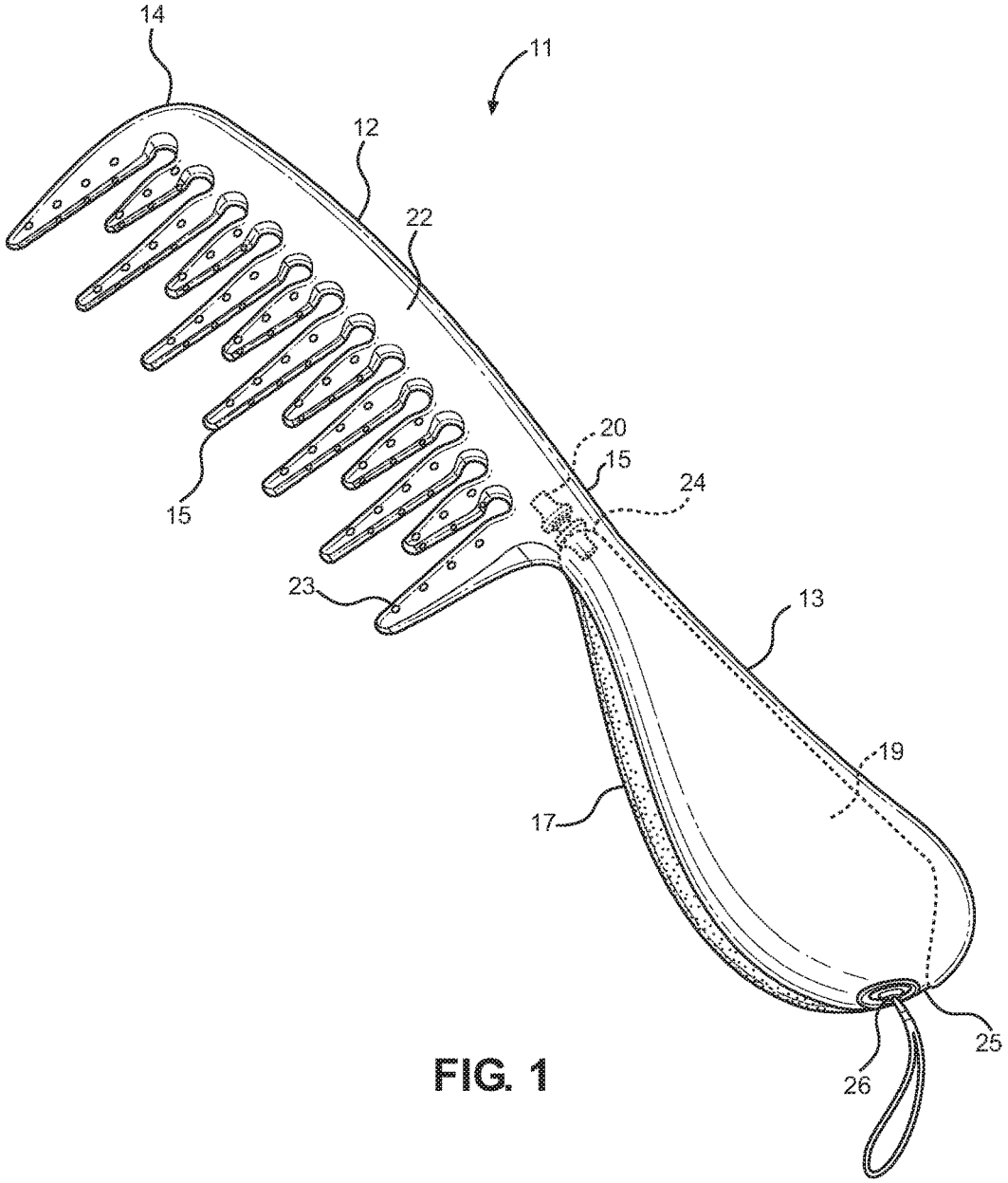
FIG. 1 shows a perspective view of the liquid dispensing comb.

Reference is made herein to the attached drawings. Like reference numerals are used throughout the drawings to depict like or similar elements of the liquid dispensing comb. For the purposes of presenting a brief and clear description of the present invention, the preferred embodiment will be discussed as used for combing hair in order to remove tangles and knots therefrom. The figures are intended for representative purposes only and should not be considered to be limiting in any respect.

Referring now to FIG. 1, there is shown a perspective view of the liquid dispensing comb. The liquid dispensing comb 11 is adapted to be used as a conventional comb in order to conveniently and painlessly untangle knotted hair. The comb 11 comprises a head 12 having a shaft 22 with a proximal end 15 and a distal end 14, wherein a handle 13 extends from the proximal end 15 thereof. In the illustrated embodiment, the handle 13 is integral with the shaft 22 of the head 12, however, in other embodiments, the shaft 22 is secured to the handle 13 by any suitable fastener. The head 12 of the comb 11 is hollow, wherein the hollow interior of the head 12 allows for liquid to pass therethrough.

A plurality of tines 15 extend perpendicularly from the shaft 22, wherein the tines 15 are also hollow to allow liquid to pass therethrough. The tines 15 are in fluid communication with the shaft 22 for allowing liquid to pass from the shaft 22 into the tines 15 of the comb 11. In the illustrated embodiment, each tine 15 comprises a circular cross section and tapers from the shaft 22 towards the distal end thereof. Further, the tines 15 preferably comprise a rounded distal tip in order to prevent injury or pain when applying pressure to a user's scalp while combing hair.

In the illustrated embodiment, one or more tines 15 of the plurality of tines 15 are provided at a first length, and one or more tines 15 of the plurality of tines 15 are provided at a second length, wherein the second length is less than that of the first length. Preferably, the plurality of tines 15 alternate between tines 15 of the first length and of the second length from the proximal end 15 to the distal end 14 of the shaft 22. In other embodiments, the tines 15 may alternate between a first length, a second length, and a third length. Preferably, the tines 15 are spaced at a fixed interval. Each tine 15 alternates in length from the adjacent tine 15 so as to allow the comb 11 to access various portions of tangled or knotted hair. The alternating tine 15 length allows different depths of the tangled hair to be accessed via the tines 15 when passing the comb 11 therethrough. This further allows for different portions of the hair to be pulled on by the comb 11, thereby releasing or untangling different parts of the hair with each stroke of the comb 11.

A plurality of apertures 23 are included along the length of each tine 15 so to allow liquid to pass therethrough. In the illustrated embodiment, the apertures 23 are circular in shape, however, in other embodiments the apertures are any suitable shape. Preferably, the apertures 23 are disposed along each tine 15, rather than between each tine 15, in order to penetrate and immediately saturate the knot with liquid.

The handle 13 comprises an open interior volume and houses a bladder 19 configured to selectively release liquid into the interior of the head 12 of the comb 11. The bladder 19 is composed of any suitable flexible material, such as rubber. Preferably, the bladder 19 is partially exposed and extends outward from the handle 13 in order to allow a user to squeeze the bladder 19. The exposed portion of the bladder 19 comprises a control 17 that allows a user to selectively release liquid into the interior of the head 12 of the comb 11. In other embodiments, the bladder 19 is fully housed within the handle 13, wherein the handle 13 is squeezable in order to selectively release liquid from the bladder 19 into the head 12 of the comb 11. In the illustrated embodiment, the bladder 19 comprises a first end 24 and a second end 25, wherein the second end 25 comprises an opening for receiving liquid therethrough. Further, the handle 13 comprises an opening aligned with the opening of the bladder 19 so as to allow a user to fill the bladder with liquid. A plug 26 removably covers the aligned openings of the bladder 19 and handle 13 so as to prevent liquid from leaving the comb 11 therethrough.

The comb 11 further comprises a valve 20 in order to control the flow of liquid from the bladder 19 to the head 12. In the illustrated embodiment, the valve 20 is secured to the first end of the bladder 19 and extends into the head 12 of the comb 11. Any suitable valve 20 can be used to selectively control the flow of liquid, such as a check valve. The valve 20 is configured to open and close in order to release liquid from the bladder 19 into the head 12 of the comb 11.

The control 17 that allows the valve 20 to open and close. In the illustrated embodiment, the control 17 comprises an edge of the bladder 19 protruding outward from the exterior of the handle 13. The flexibility of the bladder 19 allows a user to apply pressure to the control 17, thereby applying pressure on the bladder 19. As the pressure is applied to the bladder 19, liquid will be forced through the valve 20 and into the head 12 of the comb 11.

Figure 2:
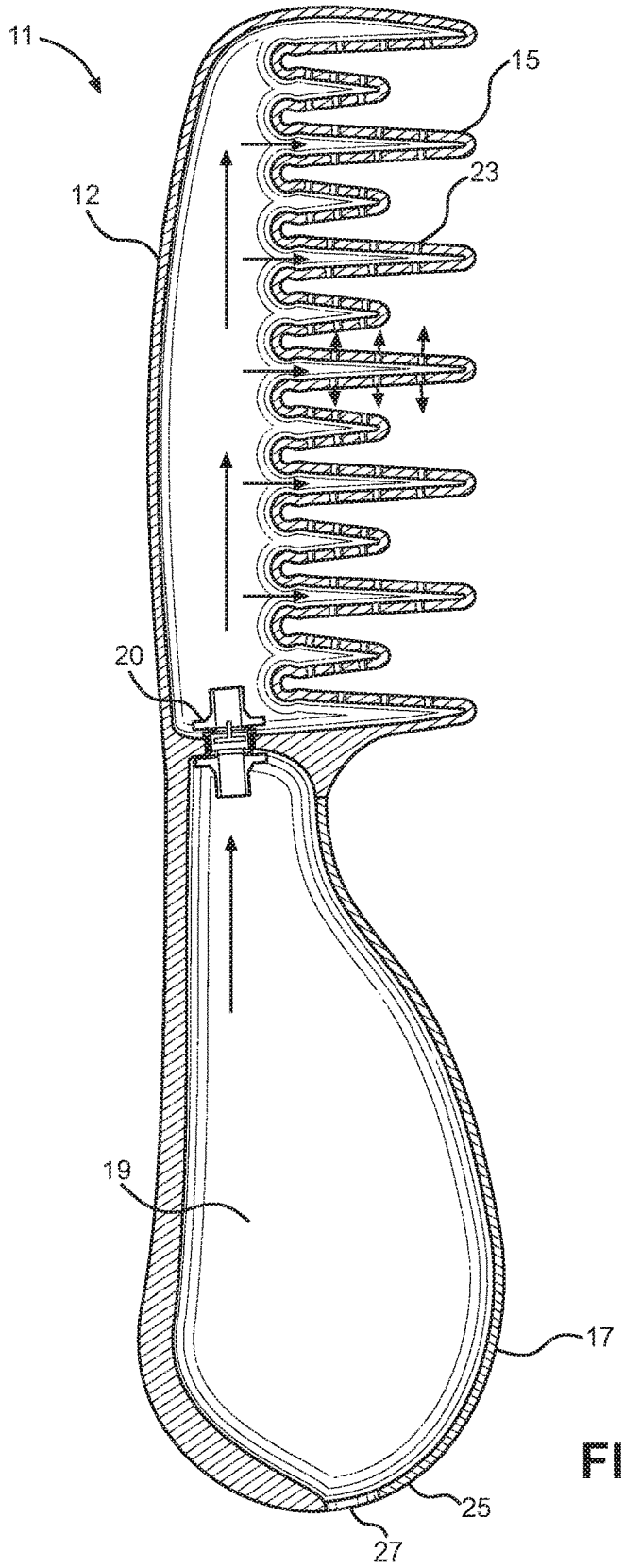
FIG. 2 shows a cross sectional view of the liquid dispensing comb.

Referring now to FIG. 2, there is shown a cross sectional view of the liquid dispensing comb. In use, the bladder 19 is filled via the opening 27 on the second end 25 thereof with liquid. Any liquid, such as water, lotion, or hair conditioner, can be used to wet hair in order to allow knots to become more easily untangled. The plug is used to cover the opening 27. Once the bladder 19 is filled with liquid, the user combs through his or her hair with the liquid dispensing comb 11 in order to untangle any knots. As knots are discovered within the user's hair, the control 17 or exposed portion of the bladder 19 is actuated in order to open the valve 20 and force the liquid therethrough. As the valve 20 is opened and the user applies pressure to the bladder 19 via the control 17, liquid flows into the head 12 of the comb 11, into the tines 15 and through the apertures 23 thereof. Once the user has saturated the desired portions of hair with the liquid dispensed from the apertures 23 of the tines 15, the bladder 19 is released, thereby closing the valve 20.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid dispensing comb, comprising:

a handle having a proximal portion, a distal portion, and an elongated opening extending between the distal and proximal portions, wherein the handle includes a hollow interior, which opens onto the elongated opening, wherein the handle includes a port therethrough to fluidly connect the hollow interior of the handle to an exterior of the liquid dispensing comb;

a head having a proximal end extending from the distal portion of the handle and an opposing distal end, wherein the head includes opposing upper and lower surfaces and opposing side surfaces disposed between the upper and lower surfaces and the head defines a hollow interior;

a plurality of tines projecting from one of the side surfaces of the head such that the plurality of tines are disposed along a length of the head between the proximal and distal ends, wherein each tine of the plurality of tines has a root end fixed to the head, an opposing terminal end and a length defined between the root and terminal ends, where the root ends are tapered such that a width of each of the plurality of tines increases from the root end until reaching a maximum width and the width decreases from the maximum width to the terminal ends, where the terminal ends are rounded and the maximum width of each tine of the plurality of tines is provided directly adjacent the respective root end thereof and each tine of the plurality of tines includes a hollow interior and a plurality of apertures disposed along the length, wherein the hollow interior of each tine of the plurality of tines is fluidly connected to the hollow interior of the head, wherein each aperture of the plurality of apertures of each tine of the plurality of tines fluidly connects the exterior of the liquid dispensing comb to the hollow interior of the tine;

a bladder having a covered portion and an exposed portion, wherein the exposed portion is disposed in the elongated opening of the handle and the covered portion is disposed in the hollow interior of the handle, wherein the covered portion includes an opening therethrough to fluidly connect an interior of the bladder to an exterior of the bladder, wherein the opening of the covered portion aligns with the port of the handle, the bladder provides a hollow interior which is fluidly connected to the hollow interior of the head by a check valve configured to allow a fluid to pass from the bladder to the head;

a plug configured to removably cover the port of the handle and the opening of the covered portion of the bladder;

wherein during use, the plug is removed to fill the bladder with liquid and then coupled to cover the opening of the bladder and the port of the handle, a volume of the liquid contained in the bladder is dispensed therefrom by applying pressure to the exposed portion of the bladder which forces the liquid through the check valve, into the head and through the tines, until the liquid exits the apertures of the tines for application of the liquid to hair.

2. The liquid dispensing comb of claim 1, wherein each tine of the plurality of tines extends perpendicularly from the length of the head, wherein each tine of the plurality of tines is planar with each tine of the plurality of tines, wherein each tine of the plurality of tines extends from one side of the length of the head, wherein the one side of the length of the head is adjacent to the exposed portion of the bladder.

3. The liquid dispensing comb of claim 2, wherein a distance between any first pair of adjacent tines of the plurality of tines is equal to a distance between any second pair of adjacent tines of the plurality of tines, wherein the length of each tine of the plurality of tines differs from a length of all tines adjacent thereto, wherein the length of each tine of the plurality of tines is selected from a group consisting of: a first length, and a second length; wherein the first length is less than the second length.

4. The liquid dispensing comb of claim 3, wherein the plurality of tines includes a distal end tine, a proximal end tine, and a plurality of intermediate tines disposed between the distal end tine and the proximal end tine; wherein each tine of the plurality of tines include a distal surface, a proximal surface and opposing upper and lower surfaces disposed between the distal and proximal surfaces and the width of each of the plurality of tines is defined as the distance between the distal and proximal surfaces thereof.

5. The liquid dispensing comb of claim 4, wherein the plurality of apertures includes a first set of apertures and a second set of apertures, where the first set of apertures is disposed along the distal surfaces of the proximal end tine and each of the intermediate tines and the second set of apertures is disposed along the proximal surfaces of the distal end tine and each of the intermediate tines.

6. The liquid dispensing comb of claim 5, wherein the plurality of apertures includes a third set of apertures, wherein the third set of apertures is disposed along the upper surface of each tine of the plurality of tines.

* * * * *